US007585368B2

(12) United States Patent
Lin et al.

(10) Patent No.: US 7,585,368 B2
(45) Date of Patent: Sep. 8, 2009

(54) PAINT-SPRAYING PLATFORM

(75) Inventors: Chi Kuang Lin, Taoyuan Hsien (TW); Jing-Yuan Chang, Taipei (TW)

(73) Assignee: Hua Yan Top Co., Ltd., Taipei (TW)

( * ) Notice: Subject to any disclaimer, the term of this patent is extended or adjusted under 35 U.S.C. 154(b) by 459 days.

(21) Appl. No.: 11/488,676

(22) Filed: Jul. 19, 2006

(65) Prior Publication Data

US 2008/0017102 A1 Jan. 24, 2008

(51) Int. Cl.
*B05B 15/04* (2006.01)
*B05C 13/00* (2006.01)
*B08B 15/02* (2006.01)

(52) U.S. Cl. ..... 118/326; 118/500; 118/501; 118/504; 454/56; 454/57

(58) Field of Classification Search ..... 118/326, 118/309, 634, 50, DIG. 7, 500–505; 454/50, 454/53, 55, 63, 56, 57; 55/DIG. 46, 49; 427/478; 312/259; 229/145, 164, 122, 138, 125; 206/45.29; 211/113, 119
See application file for complete search history.

(56) References Cited

U.S. PATENT DOCUMENTS

| | | | | | |
|---|---|---|---|---|---|
| 2,336,731 | A * | 12/1943 | Henderson | ..... | 206/45.29 |
| 3,531,170 | A * | 9/1970 | Boyer | ..... | 312/259 |
| 4,760,951 | A * | 8/1988 | MacGregor | ..... | 229/125 |
| 5,162,132 | A * | 11/1992 | Diaz | ..... | 427/470 |
| 7,316,749 | B2 * | 1/2008 | Smith | ..... | 118/326 |
| 2006/0273144 | A1 * | 12/2006 | Chen | ..... | 229/122 |

* cited by examiner

*Primary Examiner*—Yewebdar T Tadesse
(74) *Attorney, Agent, or Firm*—Troxell Law Office PLLC

(57) ABSTRACT

A simply-constructed paint-spraying platform comprises: a platform body comprising a top wall, a ventilation part, a bottom wall, two support plates, and a backing plate. When in use, the paint-spraying platform is expanded, and the article to be painted is hung on the first and second hooking holes or placed on the backing palate for spraying paint by using a spray gun. Therefore, the advantages including easy carriage, good ventilation, low cost, and enhanced steadiness can be provided.

4 Claims, 8 Drawing Sheets

PAINT-SPRAYING PLATFORM

FIELD OF THE INVENTION

The present invention relates to a simply-constructed paint-spraying platform, and more particularly to a foldable and expandable paint-spraying platform to provide the advantages including easy carriage, good ventilation, low cost, and enhanced steadiness.

BACKGROUND OF THE INVENTION

The students and non-professional persons generally use a simply-constructed and paper-made paint-spraying platform for performing the paint spraying process. This simply-constructed paint-spraying platform is commonly a foldable paper box. In the opening mode, the foldable paper box has an opening on the front surface to prevent the paint from random scattering, and thus no cleaning is required. Therefore, it is very convenient to use.

However, the conventional paint-spraying platform has drawbacks as listed below:

1. The paper plates on both sides of the opening are foldable/unfoldable and very unsteady, and thus the paper plates may be refolded up easily, causing the paint-spraying platform to be toppled down easily when the article to be sprayed is hung thereon.

2. In the absence of ventilation hole, the odor of paint, which generates peculiar smell, is left on the paint-spraying platform easily.

3. A high-cost honeycomb-shaped pad is mounted on the paint-spraying platform under the opening for holding the article to be sprayed, and the total cost is thus increased.

As a result, there exists a need to disclose an improved paint-spraying platform for overcoming the conventional drawbacks.

SUMMARY OF THE INVENTION

In view of the aforesaid drawbacks of the conventional structure, a major object of the present invention is to disclose a steady, good-ventilation, and low-cost paint-spraying platform.

In order to achieve the above-mentioned object, a paint-spraying platform comprises: a platform body comprising a top wall, a ventilation part, a bottom wall, two support plates, and a backing plate.

The top wall comprises a top reception plate and a bottom reception plate. The top reception plate has at lest one first insertion plate on the top, at least one insertion notch and a first folding edge on the bottom, and two first positioning fins on both sides, respectively. The bottom reception plate has a second folding edge on the bottom, a third folding edge between the second folding edge and the first folding edge, and two first insertion holes penetrating through both sides, respectively.

The ventilation part is for connection with the top wall via the second folding edge on the top. The ventilation part has a fourth folding edge on the bottom, a first ventilation hole penetrating through the region between the fourth folding edge and the second folding edge, a first ventilation device connected with the first ventilation hole, two second positioning fins located on both sides of the first ventilation hole, respectively, two fifth folding edges formed on the bottoms of the second positioning fins, respectively, and two second insertion holes formed on the center regions of the fifth folding edges, respectively.

The bottom wall has a bottom plate on the center. The bottom plate has a ventilation folding plate on the top, two lateral folding plates on both sides, and a bottom folding plate on the bottom. The top of the ventilation folding plate can be bent by means of the fourth folding edge to connect with the ventilation part. The ventilation folding plate has two first positioning plates protruding respectively from both sides and a sixth folding edge on the bottom. At least one second ventilation hole penetrates through the region between the sixth folding edge and the fourth folding edge for ventilation. Each of the lateral folding plates has a second insertion plate at the outer border, a seventh folding edge on the bottom, a second insertion hole penetrating through the seventh folding edge, and a second double-folding section formed on the center region between the seventh folding edge and the second insertion plate. The second double-folding section has a first folding line and a second folding line on both sides, respectively. The lateral folding plate has a second positioning plate and a third positioning plate protruding from one side. The bottom folding plate has a plurality of third insertion plates protruding from the bottom, an eighth folding edge on the top, a third insertion hole penetrating through the eighth folding edge, and a third double-folding section formed on the center region between the third insertion hole and the third insertion plates. The third double-folding section has a first folding line and a second folding line on both sides, respectively.

The support plates are for connection with both sides of the top wall and the ventilation part, and the support plates are located on the bottom wall. Each of the support plates has a first protruding plate protruding from the top. The first protruding plate has a folding line on the bottom and a positioning hole penetrating through the folding line, wherein the positioning hole is located in position corresponding to the first positioning fin. Each of the support plates has a second protruding plate and a third protruding plate protruding from one side, wherein the second and third protruding plates are located in positions corresponding to the first and second insertion holes, respectively.

The backing plate has two vertical plates respectively on both sides, at least one through hole penetrating through one surface, and a second ventilation device connected to the through hole.

When in use, the paint-spraying platform is expanded, and the article to be painted is hung on first and second hooking holes or placed on the backing palate for spraying paint by using a spray gun.

By means of the above-mentioned structure, the paint-spraying platform of the present invention overcomes the conventional drawbacks and provides the advantages as follows:

1. Two support plates that have no folding line formed thereon can bilaterally support the platform body to provide high steadiness.

2. The paint-spraying platform has several ventilation holes and ventilation devices to provide good ventilation, and the ventilation devices further allow the paint to be left in the platform.

3. The backing plate that achieves purposes effectively is simply-constructed, and the total cost is thus reduced.

DETAILED DESCRIPTION OF THE PREFERRED EMBODIMENT

Figure 1:
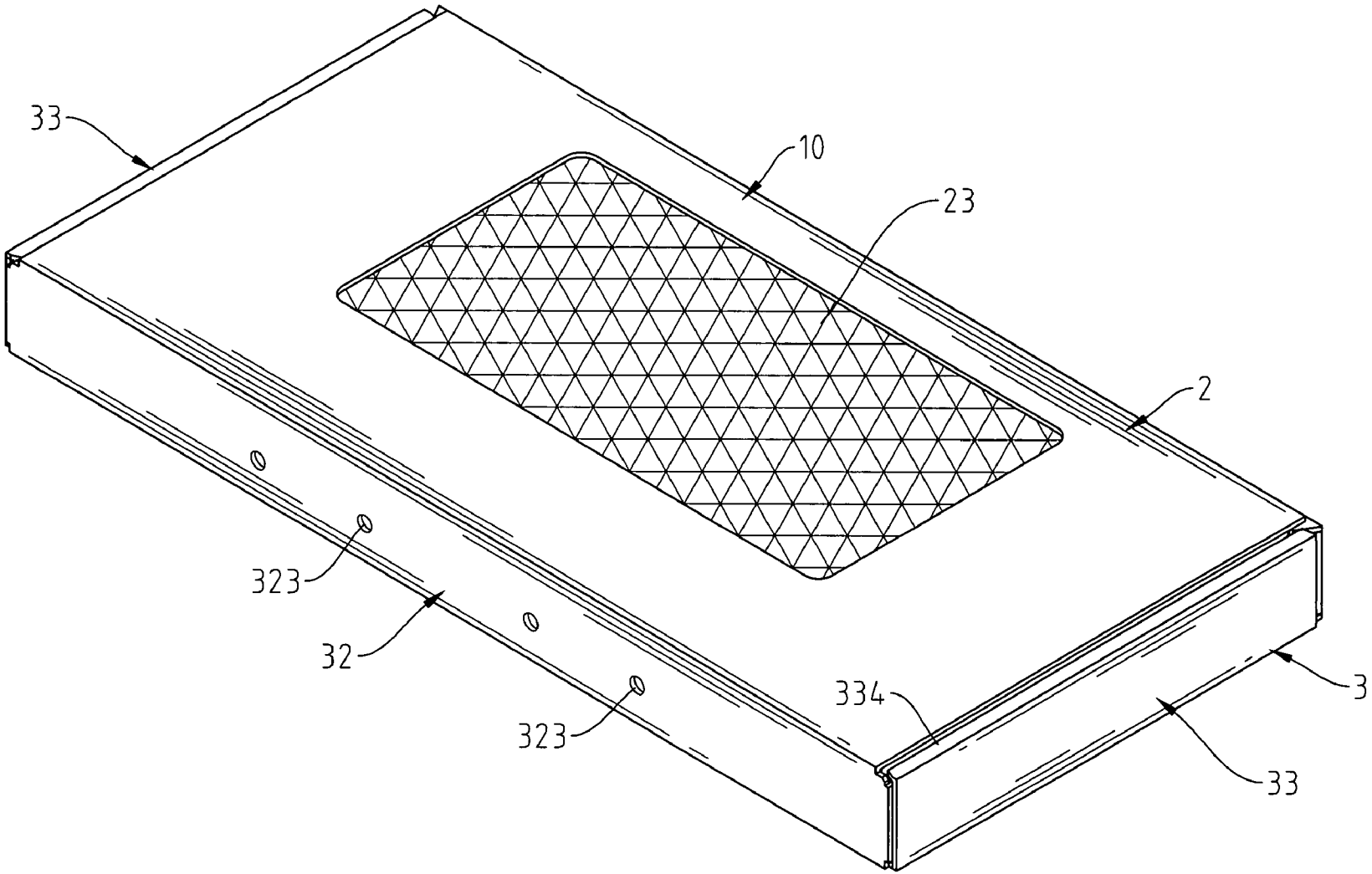
FIG. 1 is an elevational diagram showing the closing status of the present invention.

The objects, features, advantages, and benefits of the invention will become apparent in the following description taken in conjunction with the foregoing drawings.

Referring to FIGS. 2 through 6, a paint-spraying platform of the present invention comprises a platform body 10 comprising a top wall 1, a ventilation part 2, a bottom wall 3, two support plates 4, and a backing plate 5.

The top wall 1 has a top reception plate 11 and a bottom reception plate 12, wherein the top reception plate 11 further has at lest one first insertion plate 111 on the top, at least one insertion notch 112 on the bottom, and a first folding edge 113 on the bottom. The top wall 1 further has a first double-folding section 114 on the center region between the insertion notch 112 and the first insertion plate 111. A first folding line 115 and a second folding line 116 are formed on both sides of the first double-folding section 114, respectively. Several first hooking holes 117 are formed between the first folding line 115 and the first insertion plate 111. Several second hooking holes 118 are formed between the second folding line 116 and the insertion notch 112. Two first positioning hems 119 are formed on both sides of the top reception plate 11, respectively. The aforesaid first double-folding section 114, the first folding line 115, and the second folding line 116 jointly allow the top reception plate 11 to be foldable. After folding, the first insertion plate 111 can be correspondingly inserted into the insertion notch 112, and the first hooking holes 117 and the second hooking holes 118 are located in positions corresponding to one another. The top of the bottom reception plate 12 can be bent by means of the first folding edge. 113 to connect with the top reception plate 11. In addition, the bottom reception plate 12 has a second folding edge 121 on the bottom. A third folding edge 122 is formed between the second folding edge 121 and the first folding edge 113. The bottom reception plate 12 further has two first insertion holes 123 penetrating through both sides, respectively.

The top of the ventilation part 2 can be bent by means of the second folding edge 121 to connect with the top wall 1. The ventilation part 2 has a fourth folding edge 21 on the bottom. The ventilation part 2 has a first ventilation hole 22 penetrating through the region between the fourth folding edge 21 and the second folding edge 121, wherein a first ventilation device 23 is connected with the first ventilation hole 22. Two second positioning hems 24 are formed on both sides of the first ventilation hole 22, respectively. Two fifth folding edges 241 are formed on the bottoms of the second positioning hems 24, respectively. Two second insertion holes 242 are formed on the center regions of the fifth folding edges 241, respectively.

The bottom wall 3 has a bottom plate 31 on the center. The bottom plate 31 has a ventilation folding plate 32 on the top and two lateral folding plates 33 on both sides, respectively. The bottom plate 31 has a bottom folding plate 34 on the bottom. The top of the ventilation folding plate 32 can be bent by means of the aforesaid fourth folding edge 21 to connect with the ventilation part 2. The ventilation folding plate 32 has two first positioning plates 321 protruding from both sides, respectively. The ventilation folding plate 32 has a sixth folding edge 322 on the bottom. The bottom wall 3 has at least one second ventilation hole 323 penetrating therethrough the region between the sixth folding edge 322 and the fourth folding edge 21. Each lateral folding plate 33 has a second insertion plate 331 at the outer border and a seventh folding edge 332 on the bottom. The bottom wall 3 has a second insertion hole 333 penetrating through the seventh folding edge 332. In addition, a second double-folding section 334 is formed on the center region between the seventh folding edge 332 and the second insertion plate 331. Each second double-folding section 334 has a first folding line 335 and a second folding line 336 on both sides, respectively. Each lateral folding plate 33 has a second positioning plate 337 and a third positioning plate 338 protruding from one side. The aforesaid bottom folding plate 34 has several third insertion plates 341 protruding from the bottom and an eighth folding edge 342 on the top. In addition, the bottom folding plate 34 has a third insertion hole 343 penetrating through the eighth folding edge 342. A third double-folding section 344 is formed on the center region between the third insertion hole 343 and the third insertion plates 341. The third double-folding section 344 has a first folding line 345 and a second folding line 346 on both sides, respectively.

The support plates 4, which are for connection with respective both sides of the top wall 1 and the ventilation part 2, are located on the bottom wall 3. Each support plate 4 has a first protruding plate 41 protruding from on the top. The first protruding plate 41 has a folding line 42 on the bottom and a positioning hole 43 penetrating through the folding line 42. The positioning hole 43 is located correspondingly to the aforesaid first positioning fin 119. Each support plate 4 has a second protruding plate 44 and a third protruding plate 45 protruding from one side and corresponding to the first and second insertion holes 123 and 242, respectively.

The backing plate 5 has two vertical plates 51 on both sides, respectively, and at least one through hole 52 penetrating through one surface. In addition, a second ventilation device 53 is connected to the through hole 52.

The assembled structures of the aforesaid components are shown in FIGS. 1, 4, 6, and 7. The simply-constructed paint-spraying platform of the present invention is a rectangular box (shown in FIG. 1) in the closing mode. The ventilation folding plate 32, the lateral folding plates 33, and the bottom folding plate 34 are bent upward by using the sixth folding edge 322, the seventh folding edge 332, and the eighth folding edge 342. In addition, the third positioning plate 338 is bent, and the first folding lines 335 and the second folding lines 336 on respective both sides of the second double-folding sections 334 are bent oppositely so as to allow the second insertion plates 331 and the third insertion plates 341 to be inserted and positioned into the second and third insertion holes 333 and 343. Each aforesaid third positioning plate 338 is located between the first folding line 335 and the second folding line 336 on one side. Each aforesaid first positioning plate 321 is inserted between the first folding line 335 and the second folding line 336 from the other side. Each aforesaid second positioning plate 337 is inserted between the first folding line 345 and the second folding line 346.

By bending the fourth folding edge 21, the ventilation part 2 is located on the bottom wall 3, and the support plates 4 and the backing plate 5 are located between the ventilation part 2 and the bottom wall 3. By bending the fifth folding edge 241, the second positioning hems 24 can be inserted into the respective one side of the respective lateral folding plates 33, and the ventilation part 2 is positioned on the bottom wall 3. By bending the second folding edge 121 and the third folding edge 122, the top reception plate 11 and the bottom reception plate 12 can be attached to the outer surface of the bottom wall 3. In addition, the first positioning hems 119 are bent to be inserted into the second insertion holes 333, respectively, from the other side.

Figure 2:
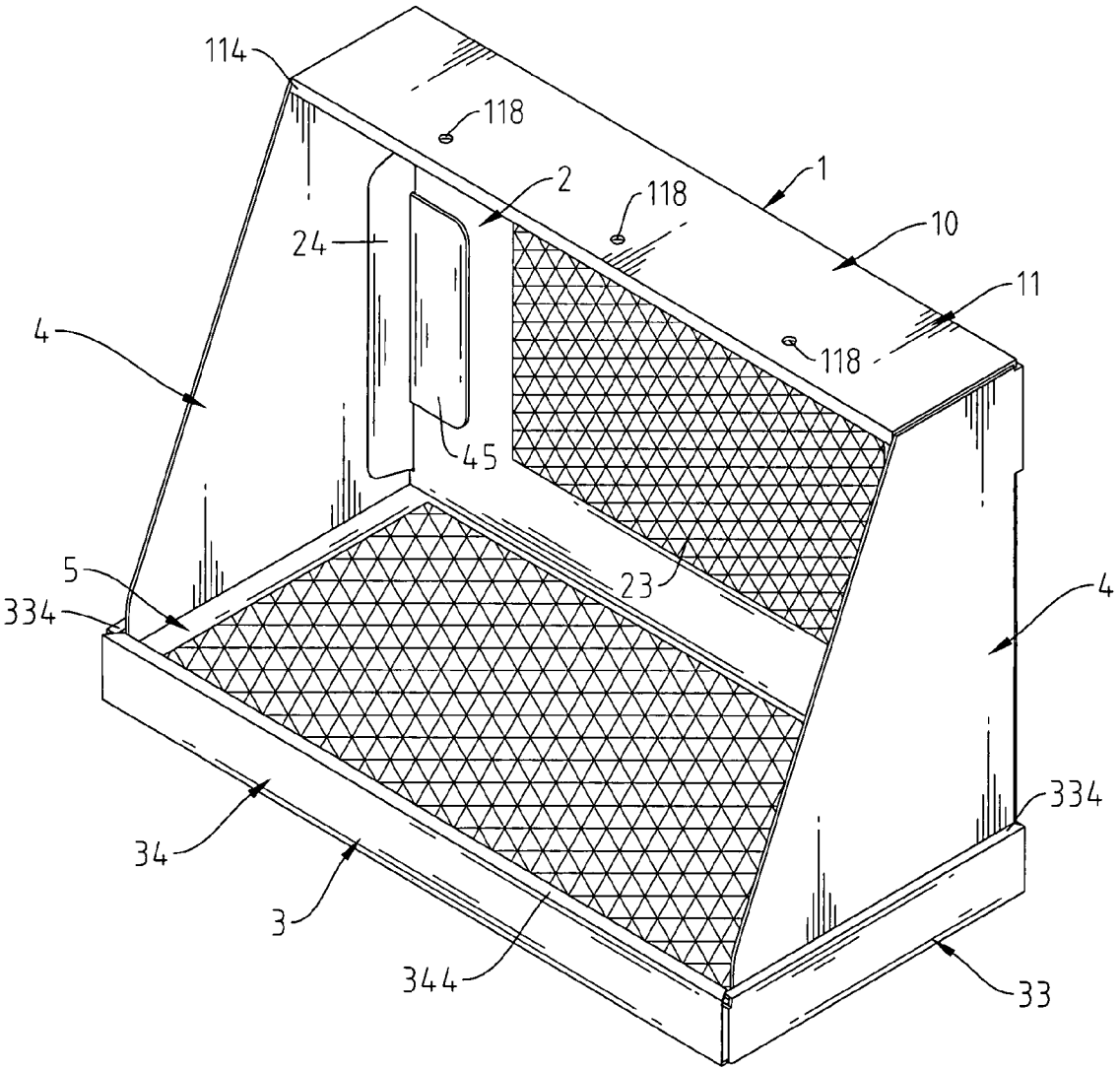
FIG. 2 is an elevational diagram showing the opening status of the present invention.
Figure 3:
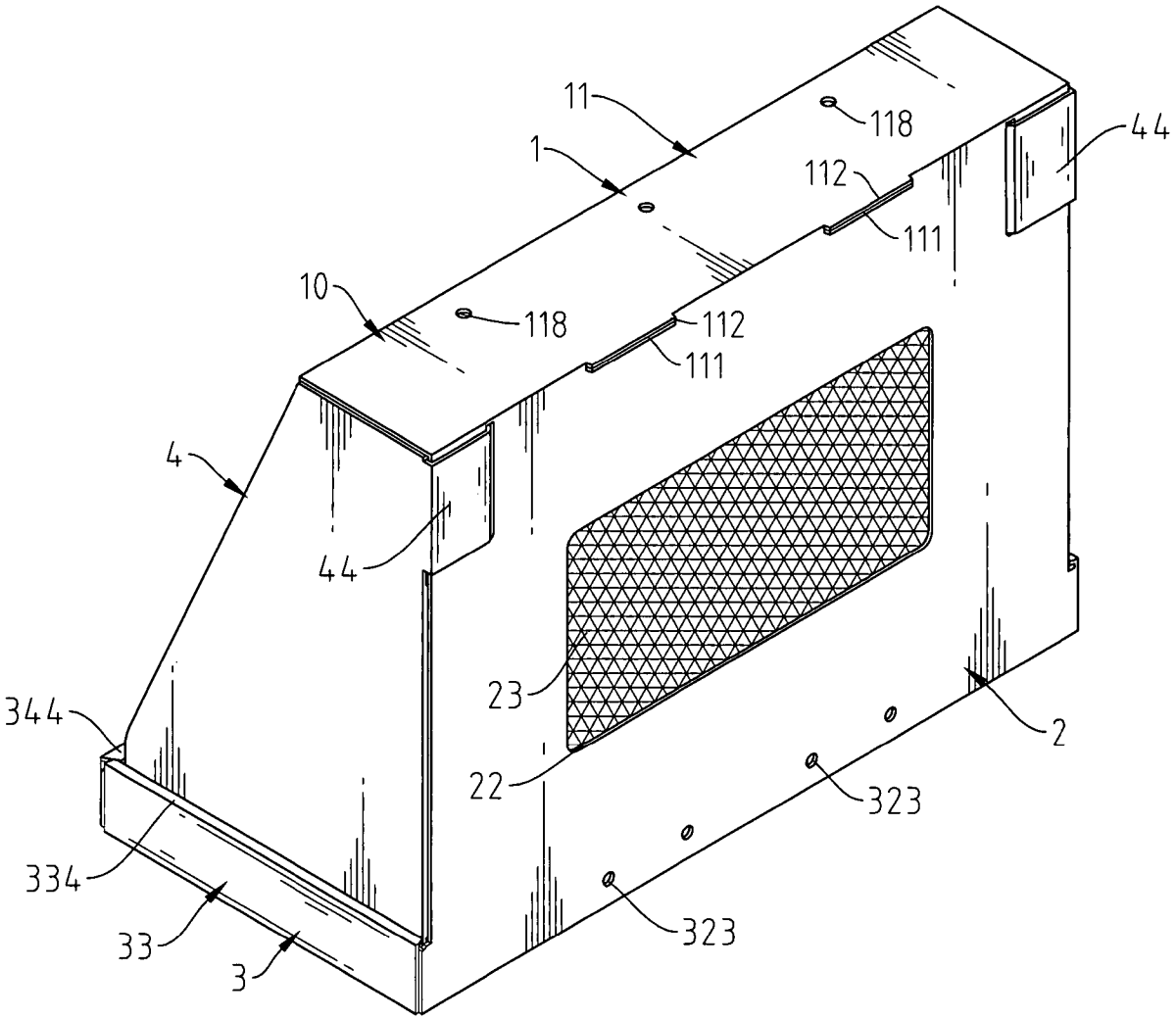
FIG. 3 is an elevational diagram showing the opening status of the present invention viewed from a different angle.
Figure 4:
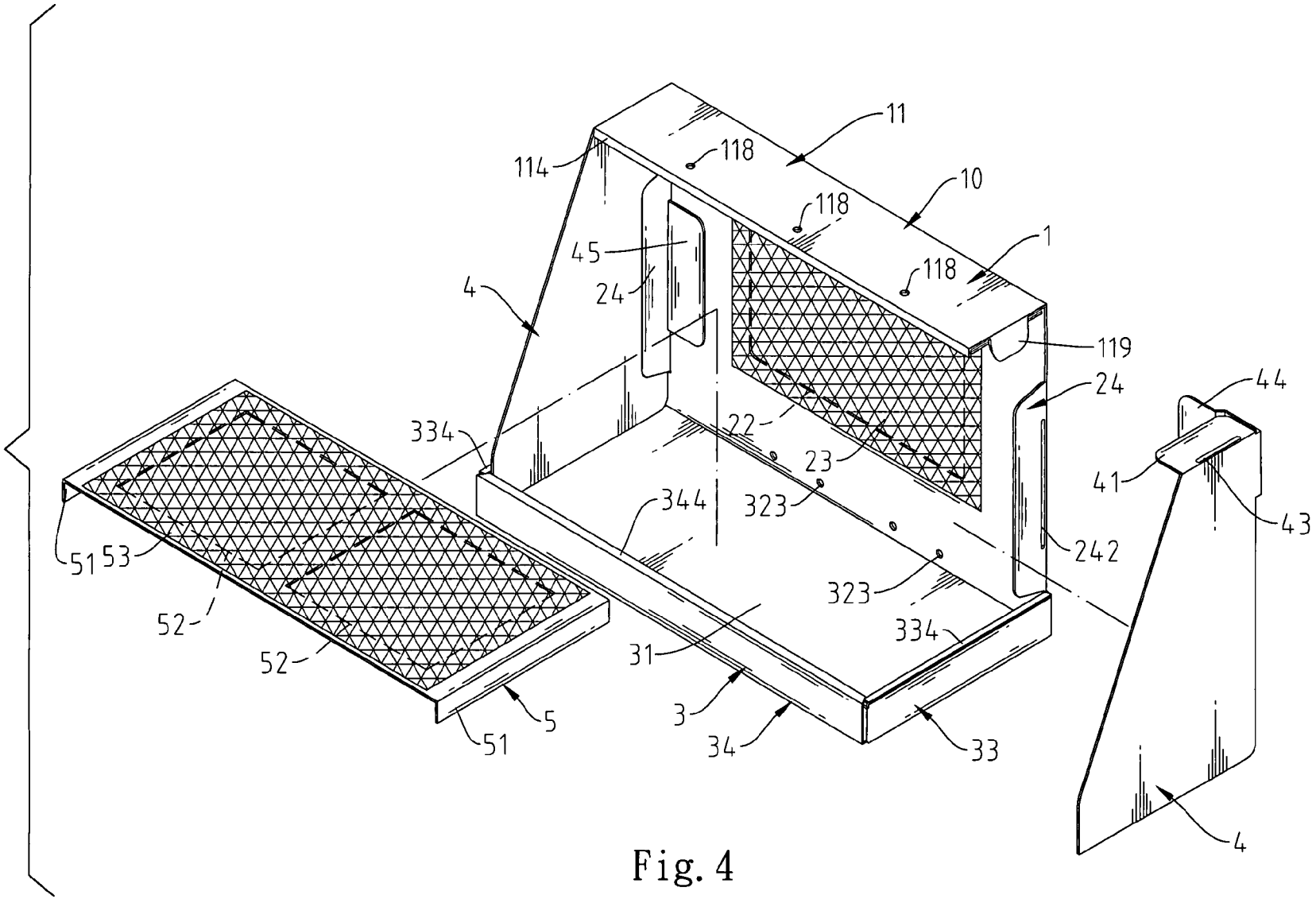
FIG. 4 is an elevational, exploded diagram of the present invention.
Figure 5:
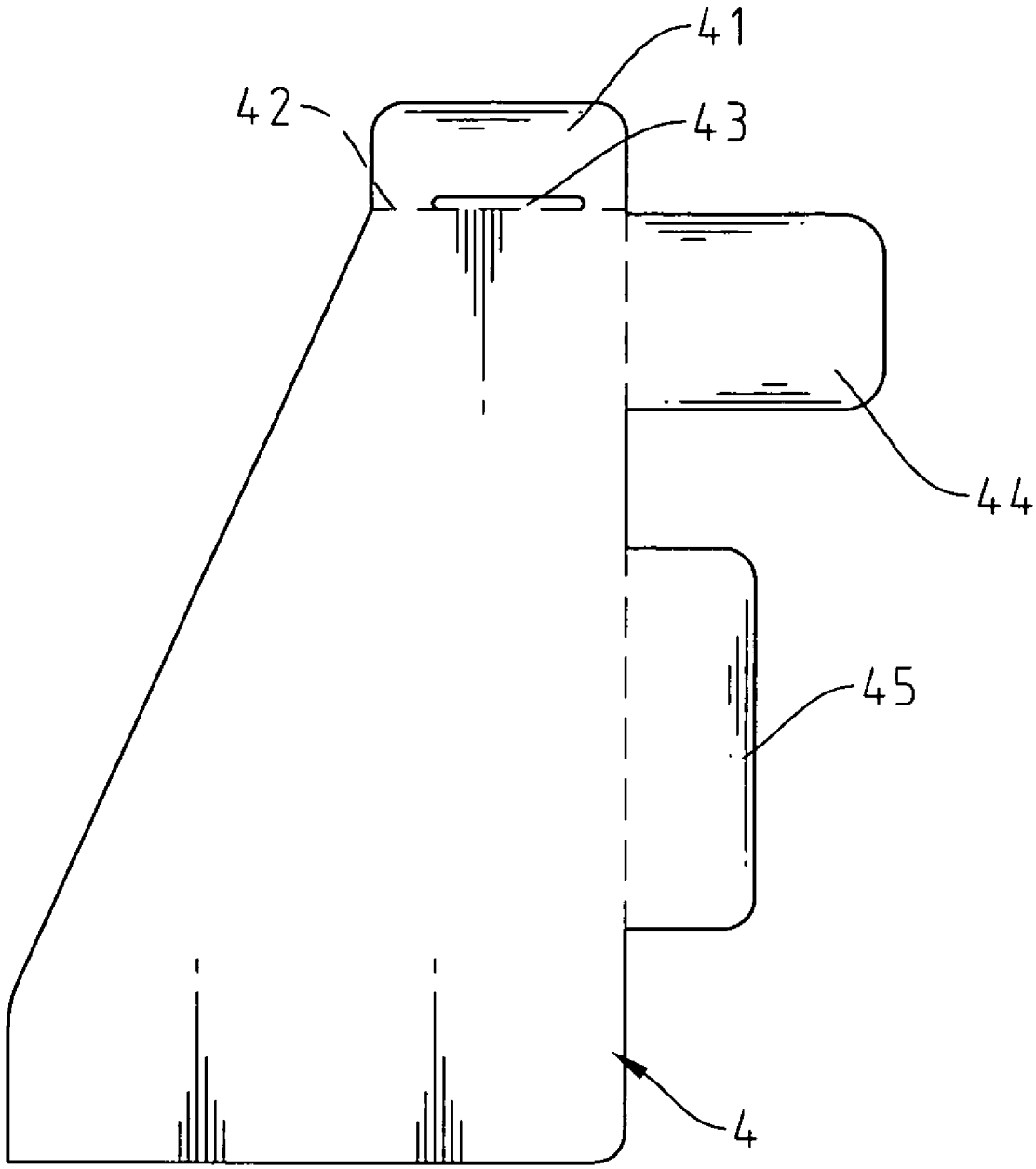
FIG. 5 is a plan diagram showing the support plate of the present invention.
Figure 6:
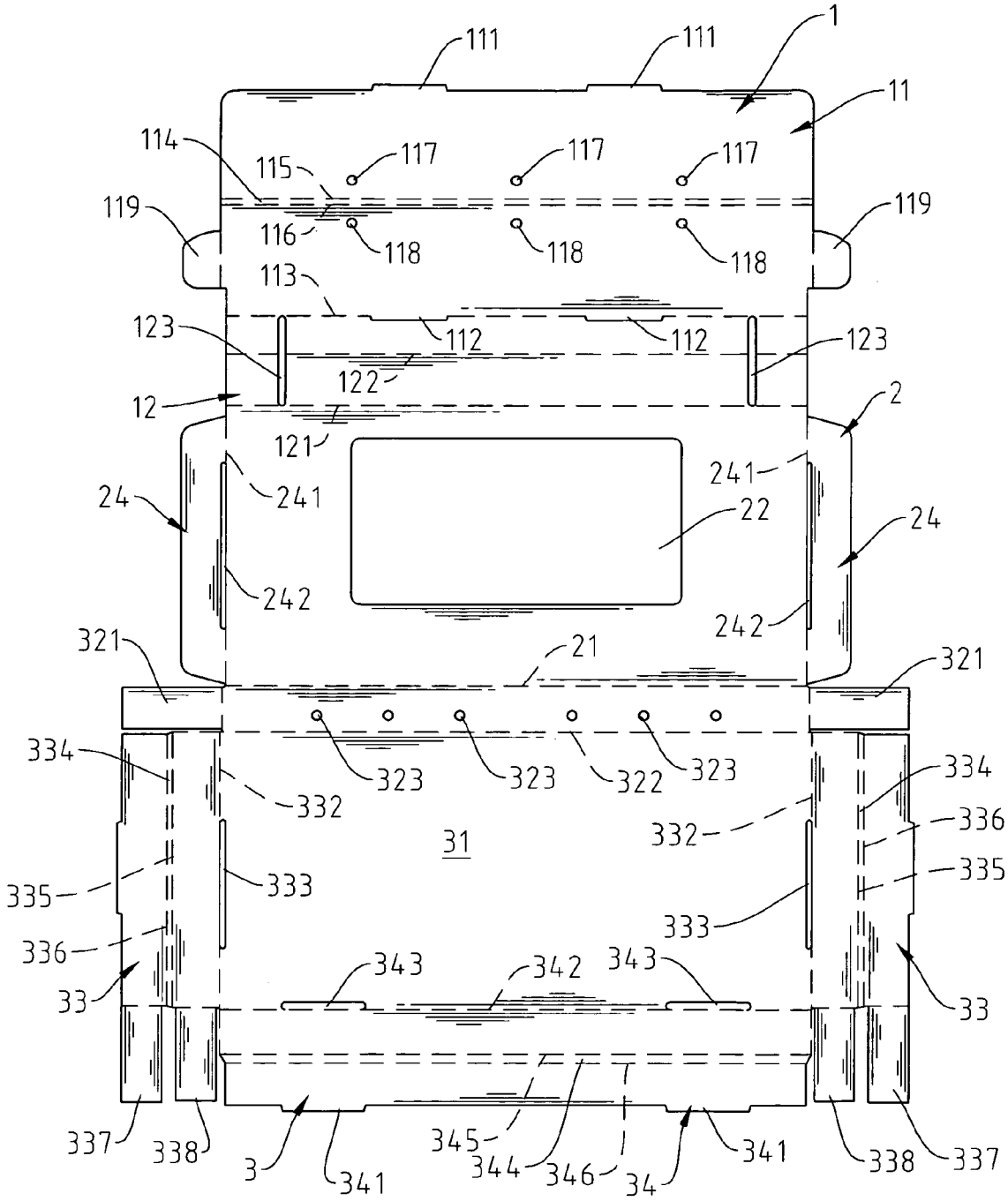
FIG. 6 is a plan diagram showing the top wall, the ventilation part, and the bottom wall of the present invention.
Figure 7:
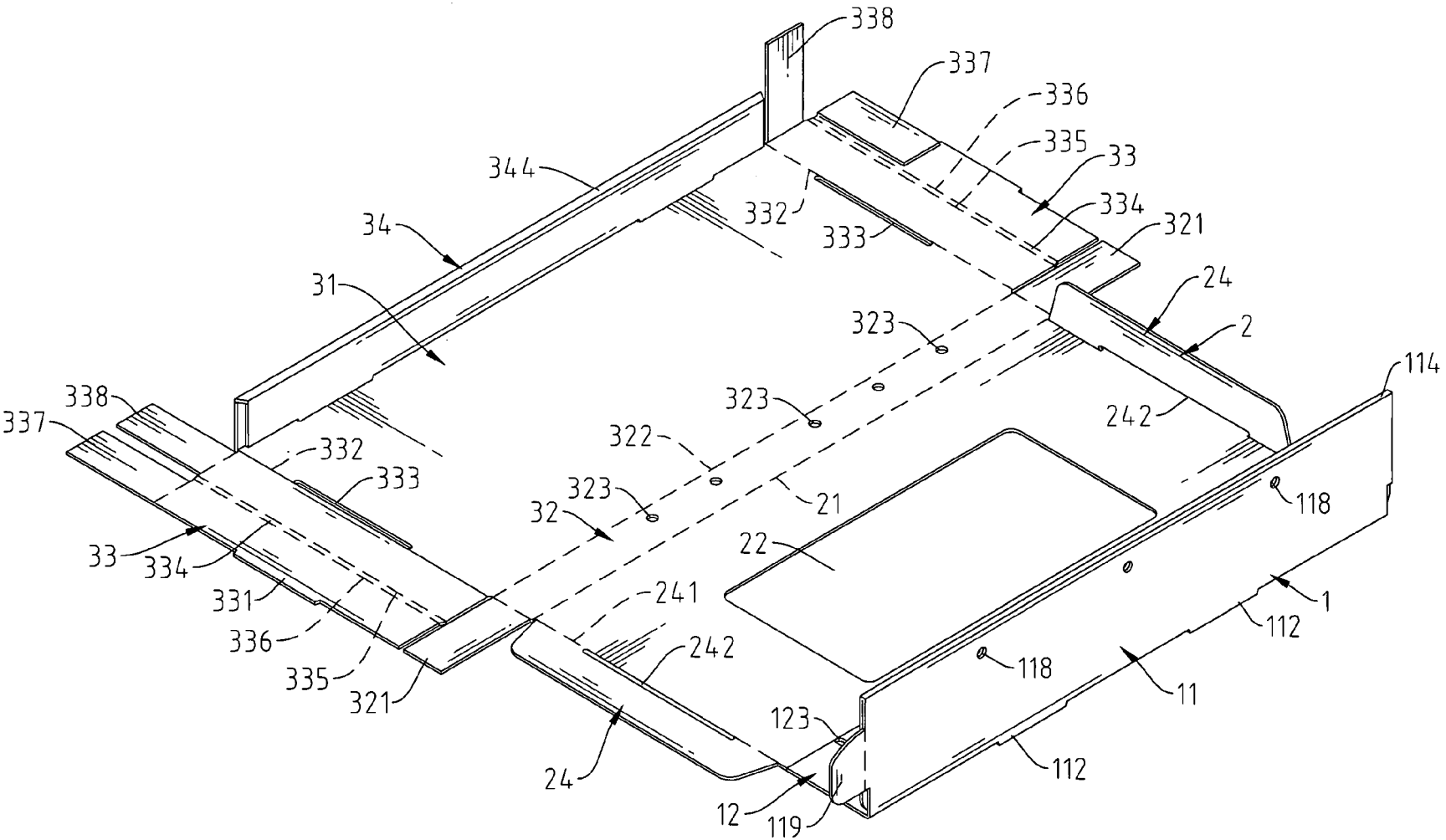
FIG. 7 is a schematic diagram showing the action for folding the top wall, the ventilation part, and the bottom wall of the present invention.

In the opening mode, as shown in FIG. 2, the folding status of the bottom wall 3 is identical to that in the closing mode. The backing plate 5 is placed on the bottom plate 31. The first folding line 115 and the second folding line 116 on both sides of the first double-folding section 114 are bent oppositely to allow the first insertion plate 111 to be inserted into the insertion notch 112 and allow the first hooking holes 117 and the second hooking holes 118 to attach to one another correspondingly. By bending the first folding edge 113, the top and bottom reception plates 11 and 12 are bended by an angle. By bending the folding lines 42 of the support plates 4, the first protruding plates 41 are bended by an angle, and the first positioning hems 119 are inserted into the positioning holes 43. In addition, the second protruding plates 44 and the third protruding plates 45 are bended by an angle and inserted into the first insertion holes 123 and the second insertion holes 242, respectively.

Figure 8:
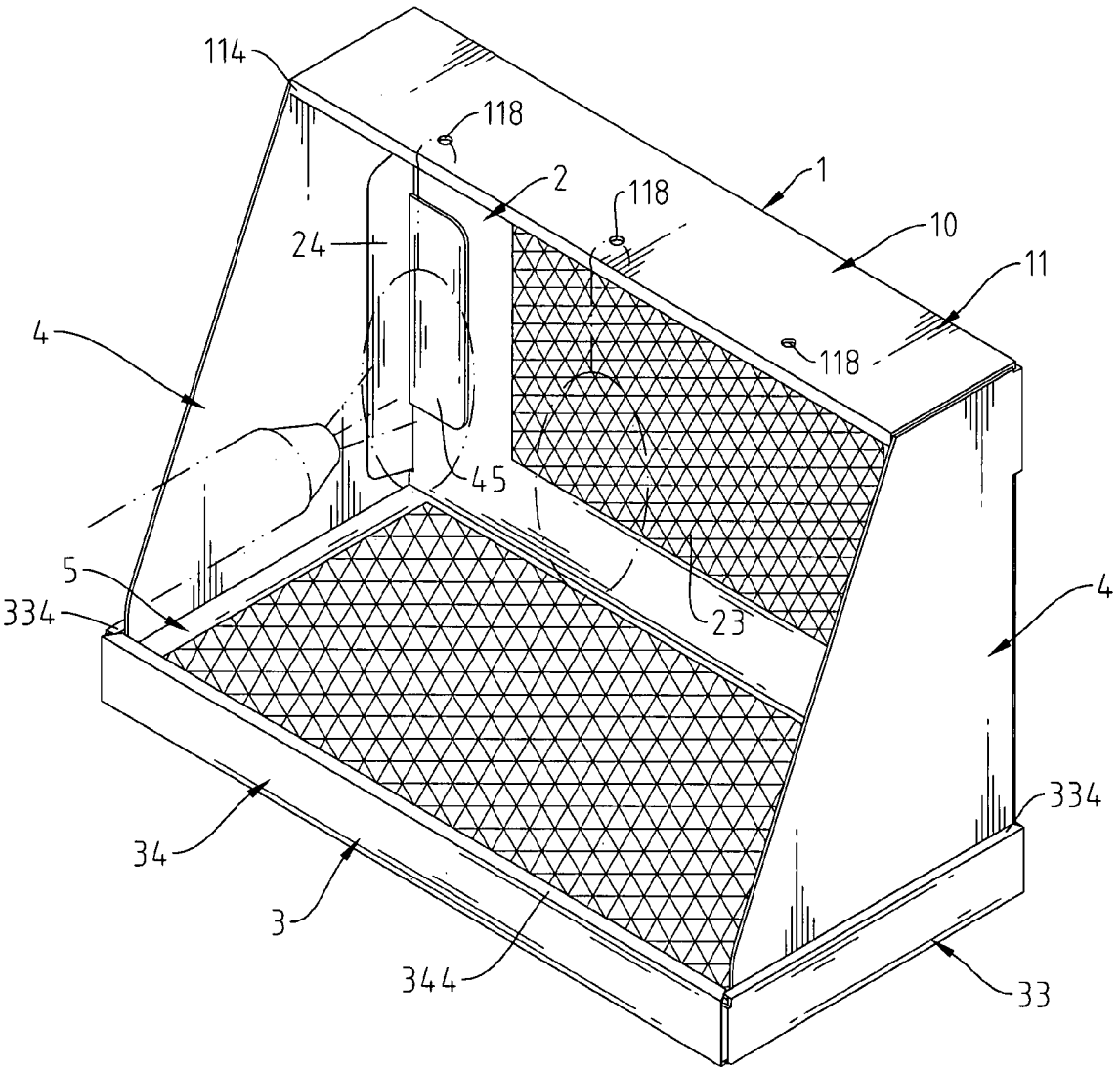
FIG. 8 is a schematic diagram showing the utilization status of the present invention.

The utilization status of the aforesaid components is shown in FIG. 8. When in use, the simply-constructed paint-spraying platform is expanded, and the article to be painted is hung on the first and second hooking holes 117 and 118 or placed on the backing palate 5 for being painted by using a spray gun.

What the invention claimed is:

1. A paint-spraying platform comprising:

a platform body comprising a top wall, a ventilation part, a bottom wall, two support plates, and a backing plate, wherein said top wall comprises a top reception plate and a bottom reception plate, said top reception plate having at least one first insertion plate on the top thereof, at least one insertion notch and a first folding edge on the bottom thereof, and two first positioning hems on both sides, respectively, said bottom reception plate having a second folding edge on the bottom thereof, a third folding edge between said second folding edge and said first folding edge, and two first insertion holes penetrating through both sides, respectively;

said ventilation part for connecting with said top wall via said second folding edge on the top thereof, said ventilation part having a fourth folding edge on the bottom thereof, a first ventilation hole penetrating through the region between said fourth folding edge and said second folding edge, a first ventilation device connected with said first ventilation hole, two second positioning hems located on both sides of said first ventilation hole, respectively, two fifth folding edges formed on the bottoms of said second positioning hems, respectively, and two second insertion holes formed on the center regions of said fifth folding edges, respectively;

said bottom wall has a bottom plate on the center thereof, said bottom plate having a ventilation folding plate on the top thereof, two lateral folding plates on both sides thereof, and a bottom folding plate on the bottom thereof, the top of said ventilation folding plate being bendable by means of said fourth folding edge to connect with said ventilation part, said ventilation folding plate having two first positioning plates protruding respectively from both sides and a sixth folding edge on the bottom thereof, each of said lateral folding plates having a second insertion plate at the outer border thereof, a seventh folding edge on the bottom thereof, one of said two second insertion holes penetrating through said seventh folding edge, and a second double-folding section formed on the center region between said seventh folding edge and said second insertion plate, said second double-folding section having a first folding line and a second folding line on both sides, respectively, said lateral folding plate having a second positioning plate and a third positioning plate protruding from one side, said bottom folding plate having a plurality of third insertion plates protruding from the bottom thereof, an eighth folding edge on the top thereof, a third insertion hole penetrating through said eighth folding edge, and a third double-folding section formed on the center region between said third insertion hole and said plurality of third insertion plates, said third double-folding section having a first folding line and a second folding line on both sides, respectively;

said two support plates are for connection with both sides of said top wall and said ventilation part and located on said bottom wall, each of said support plates having a first protruding plate protruding from the top thereof, said first protruding plate having a folding line on the bottom thereof and a positioning hole penetrating through said folding line and corresponding to said first positioning hem, each of said support plates having a second protruding plate and a third protruding plate protruding from one side thereof and corresponding to said first and second insertion holes, respectively; and said backing plate has two vertical plates on both sides, respectively, at least one through hole penetrating through one surface thereof, and a second ventilation device connected to said at least one through hole.

2. The paint-spraying platform of claim 1, wherein at least one second ventilation hole penetrates through the region between said sixth folding edge and said fourth folding edge for ventilation.

3. The paint-spraying platform of claim 1, wherein a first double-folding section is formed on the center region between said at least one insertion notch and said at least one first insertion plate, and said first double-folding section has a first folding line and a second folding line on both sides thereof.

4. The paint-spraying platform of claim 3, wherein a plurality of first hooking holes are formed between said first folding line and said at least one first insertion plate, and a plurality of second hooking holes are formed between said second folding line and said insertion notch.

* * * * *